US007355147B2

(12) United States Patent
Wang

(10) Patent No.: US 7,355,147 B2
(45) Date of Patent: Apr. 8, 2008

(54) ICE REMOVAL FOR A POND

(75) Inventor: Yu-Chin Wang, Taipei (TW)

(73) Assignee: Eiko Electric Products Corp., Taipei (TW)

( * ) Notice: Subject to any disclaimer, the term of this patent is extended or adjusted under 35 U.S.C. 154(b) by 70 days.

(21) Appl. No.: 11/482,736

(22) Filed: Jul. 10, 2006

(65) Prior Publication Data

US 2008/0006621 A1 Jan. 10, 2008

(51) Int. Cl.
*H05B 3/06* (2006.01)
*H05B 3/40* (2006.01)

(52) U.S. Cl. ..... 219/520; 219/521; 219/523; 219/533; 219/534; 219/536; 219/538; 219/541; 219/544; 219/546; 219/548; 219/552; 219/553; 392/497; 392/498; 392/499; 392/501; 43/4; 43/17

(58) Field of Classification Search ..... 219/520–1, 219/523, 533–4, 536, 538, 541, 544, 546, 219/548, 552–3; 392/497–9, 501; 43/4, 43/17; 126/271.1, 271.3
See application file for complete search history.

(56) References Cited

U.S. PATENT DOCUMENTS

| | | | | |
|---|---|---|---|---|
| 3,807,385 | A * | 4/1974 | Hedstrom | 126/360.1 |
| 4,114,304 | A * | 9/1978 | Hedlund | 126/360.1 |
| 4,253,262 | A * | 3/1981 | Johnson | 43/17 |
| 4,739,497 | A * | 4/1988 | Itoh et al. | 365/189.09 |
| 4,911,141 | A * | 3/1990 | Manuel | 126/271.1 |
| 6,778,763 | B1 * | 8/2004 | Reusche et al. | 392/499 |

* cited by examiner

*Primary Examiner*—Shawntina Fuqua
(74) *Attorney, Agent, or Firm*—Troxell Law Office, PLLC

(57) ABSTRACT

A floating ice removal device with a disk shaped upper cover, a disk shaped lower cover and a heat emitting cup. An electric circuit board is mounted on an inner bottom of the lower cover, and a helical heat emitting wire is mounted on the inner top surface of the upper cover in a contact mode, and the cup having a heat emitting source is mounted on the outer bottom surface of the lower cover. An electric power line is extended in from the bottom of the heat emitting cup to connect the circuit board to supply electric power, so that the helical heat emitting wire keeps the surface temperature of the upper cover above 5 degrees Celsius, so that the surface of the entire ice removal will not be covered by snow or ice, while the heat emitting cup can emit heat under the water for removing ice.

6 Claims, 4 Drawing Sheets

ICE REMOVAL FOR A POND

BACKGROUND OF THE INVENTION

1. Field of the Invention

The present inventions relates to an ice removal for a pond, and especially to an ice removal that can keep the surface temperature of the pond higher than about 5° C.

2. Description of the Prior Art

An ice removal for a pond is placed on the surface of water of a pond or a water bucket for breeding living things; when in a cold weather, the heat emitting from the ice removal for a pond is used to prevent freezing of the surface of water that may seal the water therebelow to be unable to contact with and obtain fresh air from the outside.

A conventional ice removal for a pond is loaded with a heat emitting means in a floating member; the heat emitting means generally is mounted on the bottom of the floating member or surrounds the inner periphery of the floating member. When the ice removal is used in a quite cold circumstance such as in a snowing weather, snowdrifts are subjected to being accumulated on the surface of the ice removal; if the ice removal is covered over, its position is uneasy to be found, this is a disadvantage in use of the conventional ice removal for a pond, and improvement is expected.

SUMMARY OF THE INVENTION

The present invention provides an ice removal for a pond to emit heat from its surface; the ice removal comprises a disk shaped upper cover, a disk shaped lower cover and a heat emitting cup, it can float on the surface of water. An electric circuit board is mounted on an inner bottom of the lower cover, and a helical heat emitting wire is mounted on the inner top surface of the upper cover in a contact mode, and the cup having a heat emitting source is mounted on the outer bottom surface of the lower cover. An electric power line is extended in from the bottom of the heat emitting cup to connect the circuit board to supply electric power, so that the helical heat emitting wire keeps the surface temperature of the upper cover above 5° C., so that the surface of the entire ice removal will not be covered by snow or ice, while the heat emitting cup can emit heat under the water for removing ice. Thereby, the defect of covering over the conventional ice removal for a pond can be overcome.

The ice removal for a pond to emit heat from its surface provided by the present invention has partitions on the inner top surface of its upper cover to form fixing means for mounting the helical heat emitting wire; thereby the helical heat emitting wire is tightly contacted with the upper cover.

The present invention will be apparent in its structure and effect of use to be achieved after reading the detailed description of the preferred embodiment thereof in reference to the accompanying drawings.

DETAILED DESCRIPTION OF THE PREFERRED EMBODIMENT

Figure 1:
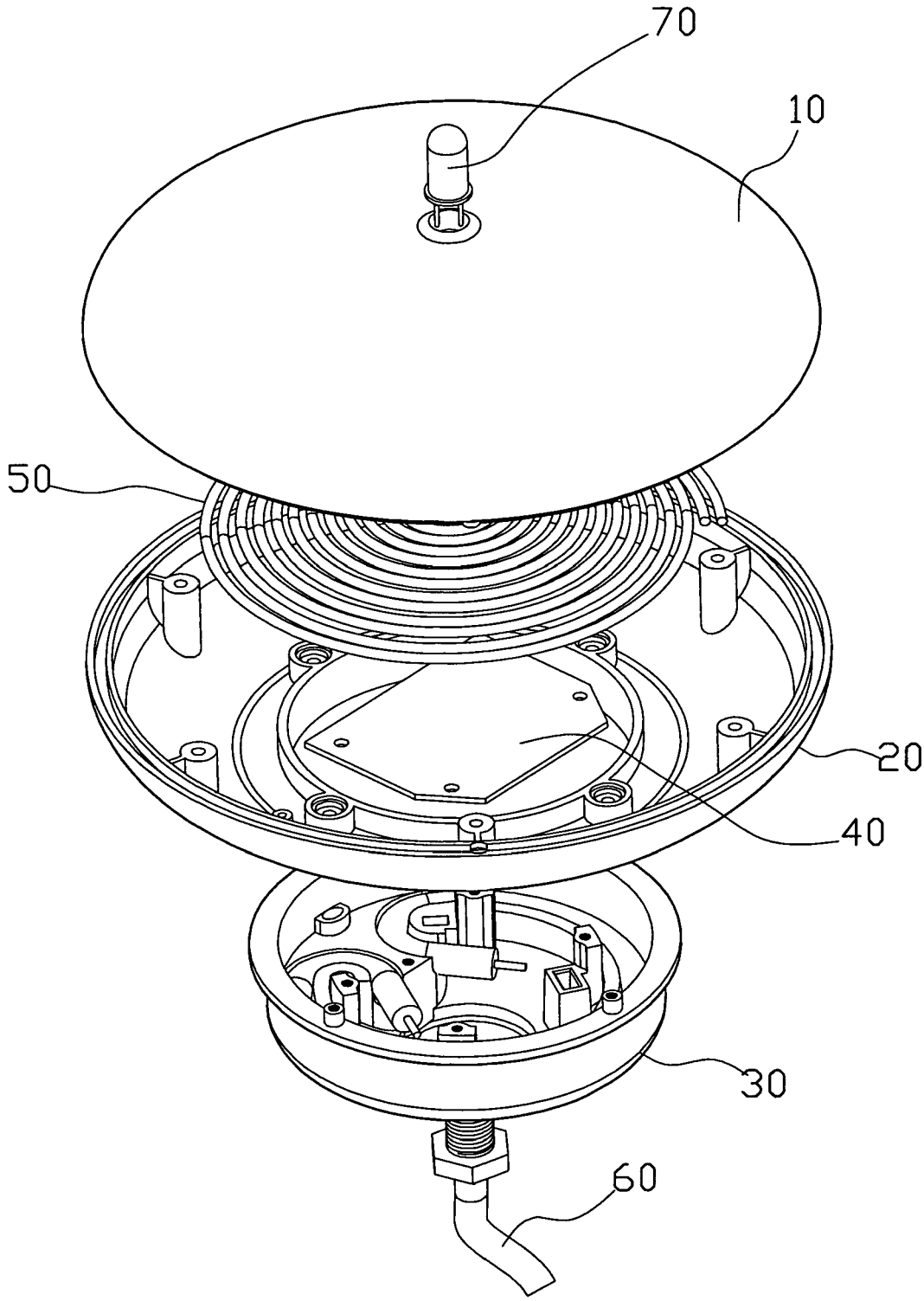
FIG. 1 is an anatomic perspective view showing a preferred embodiment of the present invention.
Figure 2:
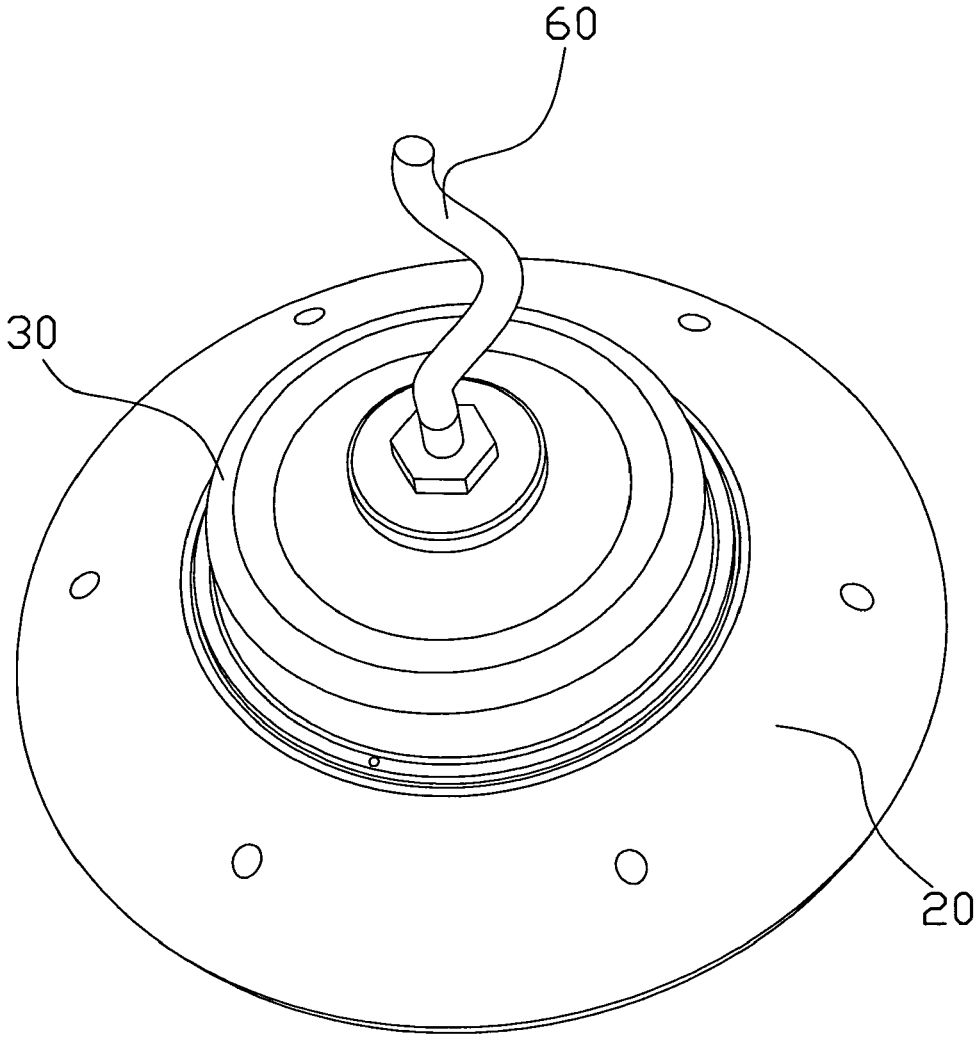
FIG. 2 is a perspective bottom view of the present invention after assembling.

Referring to FIGS. 1 and 2, the present invention mainly comprises a disk shaped upper cover 10, a disk shaped lower cover 20 and a heat emitting cup 30, it can float on the surface of water.

The peripheries of the upper cover 10 and the lower cover 20 are tightly contacted with each other to provide a function of water proofing, after assembling of them, a round disk shape or any other flat shape can be formed, for instance, an elliptic or a rectangular shape. An electric circuit board 40 is mounted on an inner bottom of the lower cover 20, the electric circuit board 40 is fixed above the heat emitting cup 30; while the upper periphery of the heat emitting cup 30 is mounted on the external bottom of the lower cover 20 in a waterproof mode. The heat emitting cup 30 is made of metal such as aluminum, the heat emitting cup 30 is installed inside the bottom of it with a circle of heat emitting source 31 that can generate heat energy to be transmitted to the outer surface to keep the surface temperature above the freezing point, in order that water will not freeze. Certainly, the tailing end of the heat emitting source 31 is connected to the electric circuit board 40.

An electric power line 60 is extended in from the central bottom of the heat emitting cup 30 in a waterproof mode, and is connected to the electric circuit board 40 for power supplying.

Figure 3:
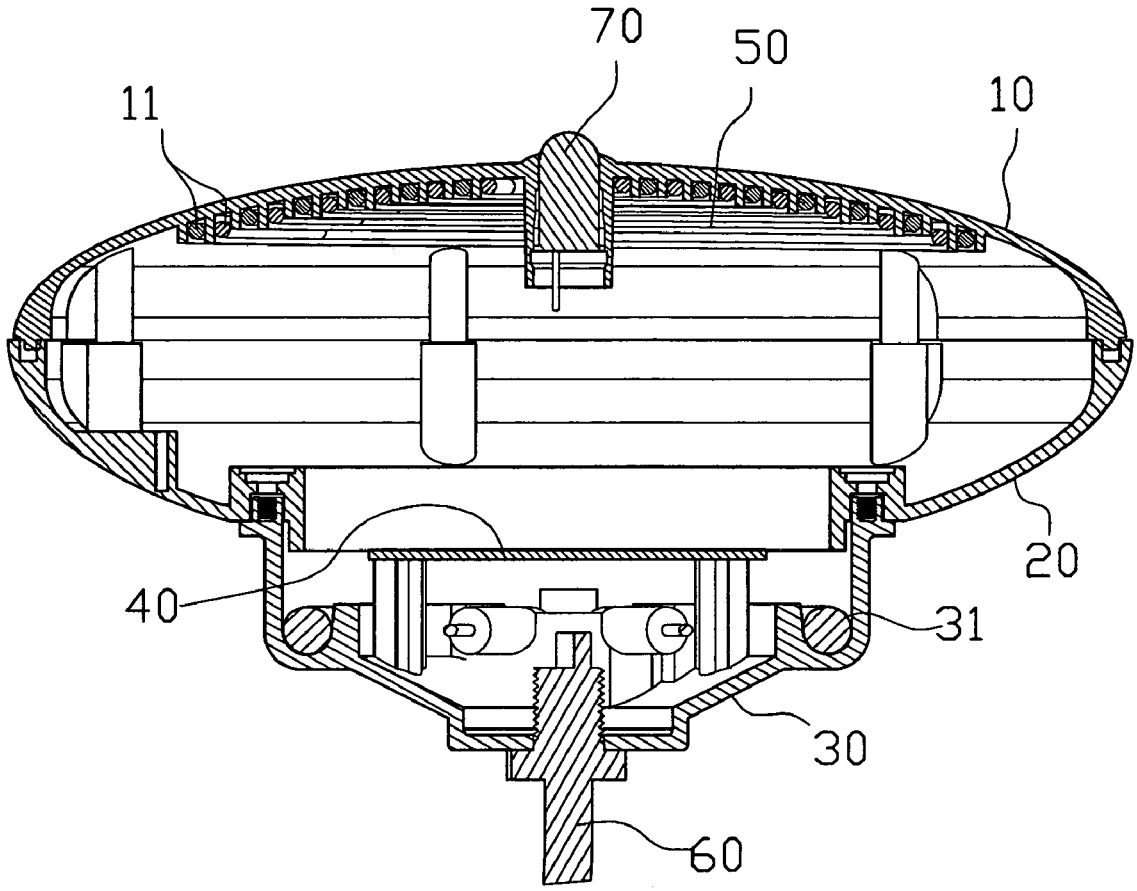
FIG. 3 is a sectional view of the present invention.

Referring to FIG. 3, the most important device is that a helical heat emitting wire 50 is mounted on the inner top surface of the upper cover 10, and the inner top surface of the upper cover 10 has partitions 11 to form fixing means for mounting the helical heat emitting wire 50, thereby the helical heat emitting wire 50 is laid out all over the inner top surface of the upper cover 10 and is made tight contact therewith, the tailing end of the helical heat emitting wire 50 also is connected to the electric circuit board 40 to obtain electric power. Most preferably, in turning on for heat emitting, the helical heat emitting wire 50 can keep the temperature on the outer surface of the upper cover 10 above the freezing point and about 5° C., in order that falling snow does not pile up.

The upper cover 10 is provided centrally thereof with an indicating lamp 70 to show whether the circuit is turned on by its lightening and extinguishing.

Figure 4:
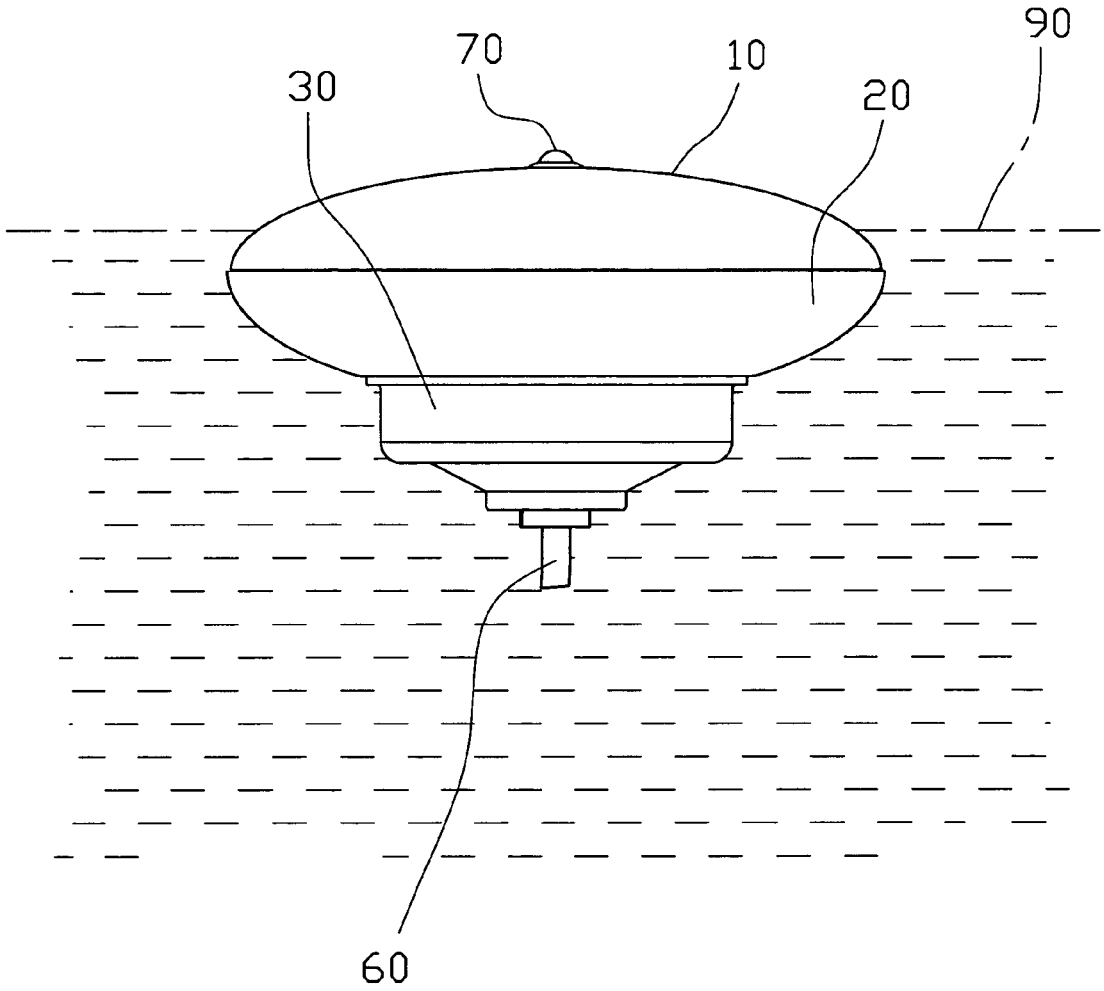
FIG. 4 is a schematic view showing use of the present invention.

FIG. 4 shows practical use of the present invention which is placed on a water surface 90; because of the material that the upper cover 10 and the lower cover 20 are made of and by virtue that the two covers are hollow, the present invention can float on the water surface 90. When the electric power line 60 provides electric power, the outer surface of the upper cover 10 can keep the temperature above that for snow melting (namely higher than 5° C.) by having heat providing of the helical heat emitting wire 50 therein; and by having the heat emitting source 31 in the heat emitting cup 30 to provide heat energy, the water will not freeze.

In conclusion, the present invention will have no snowdrifts on the outer surface of the upper cover 10, a user can find the position where the present invention is very easily even in a snowy weather. And the heat emitting cup 30 provides heat energy to prevent water from freezing, so that the water can contact with and obtain fresh air from the outside to keep the living things bred in a pond or a water bucket alive.

Having thus stated the present invention in detail, it can be understood that the present invention can have other embodiments as well as changes without departing from the spirit of it and the scope stated in the claims.

Therefore, what I claim as new and desire to be secured by Letters Patent of the United States is:

1. An ice removal for a pond to emit heat from its surface, said ice removal comprises:

an upper cover;

a lower cover connected with said upper cover in a waterproof mode to form a hollow floating member;

a heat emitting cup mounted on an external bottom of said lower cover in a waterproof mode, said heat emitting cup is installed inside its bottom with a heat emitting source that generates heat energy to be transmitted to an outer surface of said heat emitting cup;

a helical heat emitting wire mounted on an inner top surface of said upper cover in a contact mode;

an electric circuit board mounted on an inner bottom of said lower cover, a tailing end of said helical heat emitting wire and a tailing end of said heat emitting source are both connected to said electric circuit board; and an electric power line is extended in from outside of said heat emitting cup to connect said circuit board to supply electric power;

after power supplying of said electric power line, said helical heat emitting wire generates heat energy to keep outer surface temperature of said upper cover above that for snow melting, and said heat emitting source in said heat emitting cup generates heat energy to keep temperature outside of said heat emitting cup above freezing point.

2. The ice removal for a pond to emit heat from its surface as claimed in claim 1, wherein:

said ice removal has partitions on said inner top surface of said upper cover to form fixing means for laying out said helical heat emitting wire all over said inner top surface of said upper cover.

3. The ice removal for a pond to emit heat from its surface as claimed in claim 1, wherein:

said upper cover is provided centrally thereof with an indicating lamp.

4. The ice removal for a pond to emit heat from its surface as claimed in claim 1, wherein:

said heat emitting cup is made of metal.

5. The ice removal for a pond to emit heat from its surface as claimed in claim 1, wherein:

said heat emitting cup is made of aluminum.

6. The ice removal for a pond to emit heat from its surface as claimed in claim 1, wherein:

said heat emitting source in said heat emitting cup is in the shape of a circle and is provided on an inner bottom of said heat emitting source.

* * * * *